US007066770B2

(12) United States Patent
Pepe

(10) Patent No.: US 7,066,770 B2
(45) Date of Patent: Jun. 27, 2006

(54) INTERFACE ADAPTER MODULE

(75) Inventor: Paul John Pepe, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/832,550

(22) Filed: Apr. 27, 2004

(65) Prior Publication Data

US 2005/0239339 A1 Oct. 27, 2005

(51) Int. Cl.
*H01R 24/00* (2006.01)

(52) U.S. Cl. ..... 439/676; 439/418

(58) Field of Classification Search ..... 439/676, 439/452, 638, 418, 946
See application file for complete search history.

(56) References Cited

U.S. PATENT DOCUMENTS

| | | | | |
|---|---|---|---|---|
| 4,186,984 | A | 2/1980 | Reavis, Jr. et al. | 339/103 R |
| 4,738,635 | A * | 4/1988 | Harrington et al. | 439/452 |
| 4,968,260 | A | 11/1990 | Ingalsbe | 439/76 |
| 5,228,872 | A | 7/1993 | Liu | 439/607 |
| 5,938,479 | A * | 8/1999 | Paulson et al. | 439/676 |
| 6,283,795 | B1 * | 9/2001 | Chen | 439/676 |
| 6,368,144 | B1 * | 4/2002 | Viklund | 439/418 |
| 6,447,326 | B1 | 9/2002 | Teach et al. | 439/460 |
| 6,494,747 | B1 * | 12/2002 | Hwang | 439/676 |
| 6,811,446 | B1 * | 11/2004 | Chang | 439/676 |
| 2003/0232535 | A1 | 12/2003 | Pepe et al. | 439/489 |
| 2004/0014362 | A1 | 1/2004 | Slack et al. | 439/620 |

FOREIGN PATENT DOCUMENTS

| | | | |
|---|---|---|---|
| EP | 0 583 111 A1 | | 2/1994 |
| JP | 2001-210434 | * | 4/2001 |

* cited by examiner

*Primary Examiner*—Michael C. Zarroli

(57) ABSTRACT

A network interface adapter module includes a housing having a front interface end in a first contact format and a rear interface end in a second contact format that is different from the first contact format. The housing includes a plurality of front interface contacts. Each front interface contact is configured to mate with an insulation displacement contact (IDC) to receive a network sensor signal. A lead frame assembly is within the housing. The lead frame assembly interconnects each of the plurality of front interface contacts with a respective one of a plurality of receptacle contacts at the rear interface end.

18 Claims, 3 Drawing Sheets

INTERFACE ADAPTER MODULE

BACKGROUND OF THE INVENTION

The invention relates generally to connector modules that interface network components and, more particularly, to adapter modules having insulation displacement contacts.

Electronic components are typically connected to an electronic network using an interconnect module that allows connections between components on the network. Network connections are typically made using an interconnect module that is retained in a patch panel, or any number of other network structures, and which interconnects two or more separate network components. At the patch panel, cable terminations are typically made using wiring blocks, commonly known as "punch down" blocks, or other forms of interconnect devices.

In order to better operate large electronic networks, sensor systems have been developed to monitor connections between components within the network. The sensor system typically is integrated into an interconnect module that is retained in the patch panel. The interconnect module includes receptacle jacks, similar to phone jacks, at a mating face. The jacks receive patch cords that are connected to a first network component. Each patch cord includes an electrical cable comprised of signal wires connected to a plug at one end. The plug is received within a corresponding receptacle jack such that the signal wires in the electrical cable are electrically connected to signal contacts extending from a rear side of the interconnect module. The signal contacts are in turn connected to a second set of signal wires that extend to a second network component. Thus, the interconnect module electrically interconnects the first and second network components.

In a network that includes a sensor system, conventional interconnect modules are joined with separate sensor configurations that enable the network to determine when a plug is joined with a receptacle jack. Typically, sensor wiring connections, as well as signal connections are made to the interconnect module by punching down wires into the interconnect module. At least some interconnect modules include insulation displacement contacts (IDC) that pierce the wire insulation to make contact with the conductor inside the wire when the wire is pushed into, or punched down, into the contact. IDC contacts typically are housed in a projection referred to as an IDC tower on the interconnect module.

The punch down process has a number of shortcomings. For instance, installation is difficult due to space constraints and general visibility at the rear of the patch panel. In addition, each input/output (I/O) cable typically includes 24 color coded wires that must be laid out and sometimes pre-measured. Cable handling can also lead to damage to the wiring during installation, removal, and maintenance procedures.

A need exists for an interconnect adapter module that addresses the above mentioned shortcomings as well as other concerns in the prior art.

BRIEF DESCRIPTION OF THE INVENTION

In one aspect, a network interface adapter module is provided. The adapter module includes a housing having a front interface end in a first contact format and a rear interface end in a second contact format that is different from the first contact format. The housing includes a plurality of front interface contacts. Each front interface contact is configured to mate with an insulation displacement contact (IDC) to receive a network sensor signal. A lead frame assembly is within the housing. The lead frame assembly interconnects each of the plurality of front interface contacts with a respective one of a plurality of receptacle contacts at the rear interface end.

Optionally, the housing of the adapter module includes a base and a cover snapably joined to the base and a shroud at the front interface end. The housing base includes front interface contacts, each of which has an elongated body having a blade formed at a forward end and an IDC contact formed at an opposite rearward end. The blade and IDC contacts extend vertically upward from the base. The lead frame assembly includes a lead frame base having a forward end and a rearward end, a plurality of barrel IDC contacts extending vertically upward from the lead frame base, and a plurality of angled contacts extending from the rearward end. The said lead frame base includes imbedded conductive traces connecting respective ones of the barrel IDC contacts and the angled contacts.

In another aspect, network interface adapter module includes a housing having a front interface end and a rear interface end different from the front interface end. The housing includes a plurality of front interface contacts. Each front interface contact is configured to mate with an insulation displacement contact (IDC) to receive a network sensor signal. A wiring network within the housing receives network sensor wiring in a first configuration from the front interface end and converts the network sensor wiring to a second configuration at the rear interface end.

DETAILED DESCRIPTION OF THE INVENTION

Figure 1:
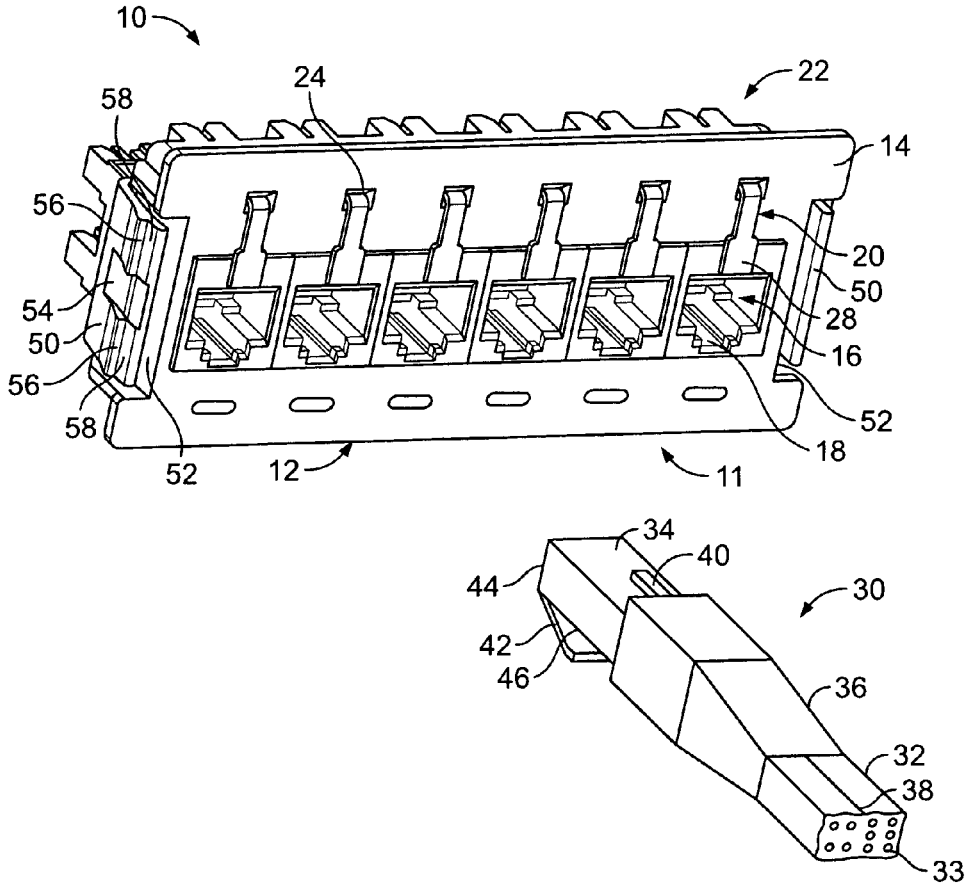
FIG. 1 (Prior Art)
FIG. 1 is a front perspective view of a known interconnect module and a patch cord.

FIG. 1 illustrates a front perspective view of a known interconnect module 10 that can be used for making connections in a network. In FIG. 1, the interconnect module 10 is viewed from a front side 11. The interconnect module 10 includes a housing 12 that has a substantially rectangular face plate 14 and a row of square receptacle jacks 16 formed in the housing 12 that open at the face plate 14. Each of the receptacle jacks 16 includes a bottom channel 18. The interconnect module 10 also includes a plurality of sensor contacts 20 that extend from the face plate 14 to a rear side 22 of the interconnect module 10 through slots 24 extending through the housing 12. One of the plurality of slots 24 is positioned adjacent each of the jacks 16. Each sensor contact 20 includes a sensor pad 28 aligned parallel to and positioned proximate the face plate 14. The receptacle jacks 16 are also located proximate the sensor pads 28, such that each receptacle jack 16 has a corresponding sensor pad 28.

A patch cord connector 30 is generally used to connect components (not shown) to the network at the interconnect module front side 11. Typically the patch cord 30 includes an insulated cable 32 and a plug 34 retained in a boot 36. The cable 32 extends to a first network component (not shown) that, by way of example only, may be a server or another interconnect module 10. The cable 32 contains several signal wires 33 that may be shielded or unshielded and made of fiber optics or copper. A probe wire 38 extends from the cable 32 to a sensor probe 40. The sensor probe extends outward from the boot 36. A flexible prong 42 extends from a front end 44 of the plug 34 rearward at an acute angle with respect to a bottom surface 46 of the plug 34 and is configured to retain the plug 34 within the interconnect module 10.

The receptacle jacks 16 receive the plugs 34. When the plugs 34 are fully received in the receptacle jacks 16, the sensor probes 40 contact and electrically engage corresponding sensor pads 28, thereby enabling sensor signals to pass in either direction between the plug 34 and interconnect module 10.

The interconnect module 10 also includes flexible latches 50 extending outward from opposite side walls 52 thereof. The flexible latches 50 have release pads 54 separating retention ledges 56 and resistance panels 58. The interconnect module 10 may be inserted into a patch panel, a wall mounted box, in a floor box, or any number of other network connection structures (not shown in FIG. 1) and retained therein by the operation of the latches 50.

Figure 2:
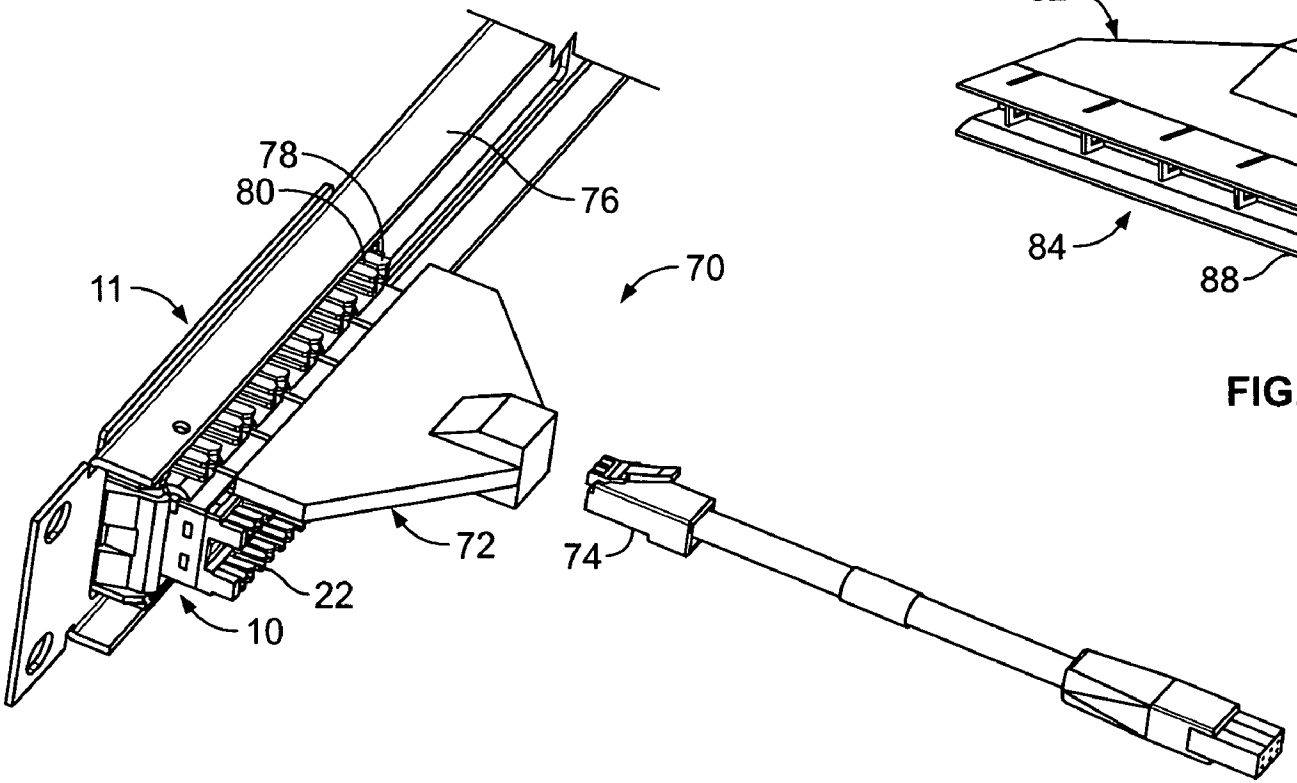
FIG. 2 is a perspective view of an interconnect system in accordance with an embodiment of the present invention.

FIG. 2 illustrates an interconnect system 70 in accordance with an embodiment of the present invention. The interconnect system 70 includes the interconnect module 10, an adapter module 72, and a plug 74. In FIG. 2, the interconnect module 10 is installed in a bracket 76. In the system 70, one or more patch cords 30 (see FIG. 1) or similar connectors are received in receptacle jacks 16 on the front side 11 of the interconnect module 10, each extending to a network component.

Each contact 20 (see FIG. 1) includes a portion (not shown) that extends through a corresponding sensor contact slot 24 and into a corresponding sensor tower 78 that extends from the rear side 22 of the interconnect module 10. In the exemplary embodiment, the contact portion within the sensor tower 78 is an insulation displacement contact (IDC) that is configured to pierce the insulation of a wire and make electrical contact with the conductor when a wire is inserted into tower slots 80 using a tool (not shown) designed for that purpose. In order to monitor network connections, a sensor signal associated with the connection must be sent to, or a sensor connection made to a network monitoring system (not shown). In the case of the interconnect module 10, the sensor connection is made by installing a wire between the sensor tower 78 and the monitoring system, that is, a wire is inserted into the IDC contact in the sensor tower 78 and routed to the monitoring system. Thus, provision is made for monitoring network connections through the patch cord sensor probe 40 and the sensor contact 20, and through the addition of a sensor connection from the sensor tower 78 to a network monitoring system. However, loading individual sensor wires into the sensor towers 78 can be a tedious and time consuming process. The interface adapter module 72 is provided to more easily connect the sensor signals to the network monitoring system. In FIG. 2, the interface adapter module is shown connecting the IDC interface of the sensor towers 78 to a receptacle such as a standard RJ11 receptacle which receives a mating RJ11 plug such as the plug 74. It is to be understood that the RJ11 receptacle and plug configurations are used for purposes of illustration only and other receptacle and plug configurations are not intended to be excluded.

Figure 3:
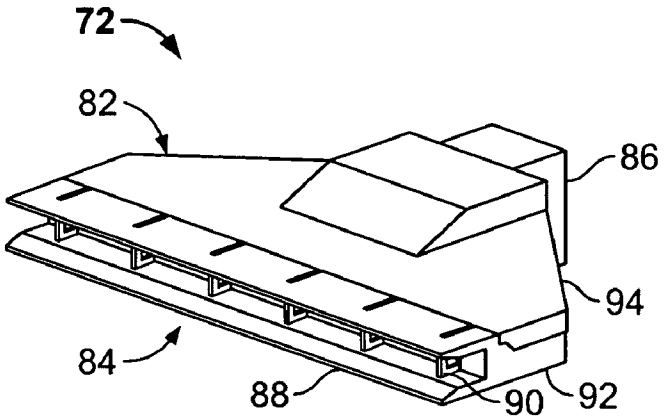
FIG. 3 is a perspective view of the interface adapter module shown in FIG. 2.

FIG. 3 illustrates a perspective view of the interface adapter module 72. The adapter module 72 includes a housing 82 that has a front interface end 84 and a rear interface end 86. The front interface end 84 includes a shroud 88 and front interface contacts 90 that are configured to be received in an IDC contact when the front interface is joined with a front loadable interconnect module such as the interconnect module 10. The housing 82 includes a base 92 and a cover 94. The cover 94 can be joined to the housing base 92 by any means commonly used in the art such as by snap fit, or by screws, etc. The adapter module 72 receives network sensor wiring in a first configuration from the front interface end 84 and converts the network sensor wiring to a second configuration at the rear interface end 86. In an exemplary embodiment, the rear interface end 86 includes an RJ11 interface. In alternative embodiments, other types of interfaces are contemplated.

Figure 4:
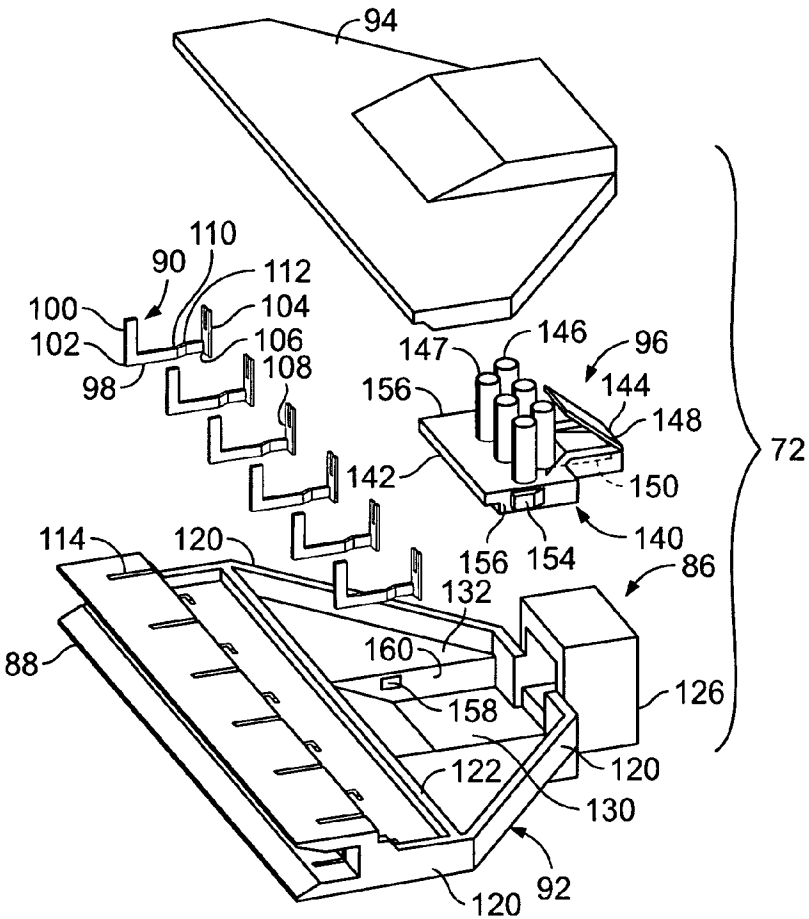
FIG. 4 is an exploded view of the interface adapter module shown in FIGS. 2 and 3.

FIG. 4 is an exploded view of the interface adapter module 72. Front interface contacts 90 and a lead frame assembly 96 are contained within the housing 82. The front interface contacts 90 include a body 98 having a blade portion 100 formed at a forward end 102 and an IDC contact portion 104 formed at an opposite rearward end 106. The blade portion 100 is configured to be matable with the IDC contacts in the sensor tower 78. The blade portion 100 and the IDC contact 104 extend vertically upward relative to the housing base 92. The IDC contact portion 104 is joined at an edge 108 to the contact body 98 and is oriented transverse to the contact body 98. The contact body 98 also includes lateral bends 110 and 112 that substantially align the blade portion 100 with a center of the IDC contact portion 104. The contacts 90 are loaded vertically, or in a direction substantially perpendicular to an upper surface of the housing base 92, into complimentarily configured slots 114 in the housing base 92. The slots 114 extend into the shroud 88 and the contact blade portions 100 are positioned within the shroud 88.

The housing base 92 has a segmented perimeter wall 120 that extends from the shroud 88. A transverse interior wall 122 traverses the housing base interior. A receptacle housing 126 is formed on the housing base 92 and joins the perimeter walls 120 at the rear 86 of the adapter module 72. A lead frame well 130 is formed in a floor 132 of the housing base 92 that receives the lead frame assembly 96. The lead frame assembly includes a lead frame base 140 that has a forward end 142 and a rearward end 144. A plurality of barrel IDC contacts 146 extend vertically upwardly from the lead frame base 140. Each barrel IDC contact 146 includes a slit 147 that receives an insulated wire 190 (see FIG. 6) and pierces the insulation to make contact with the conductor in the wire 190. A plurality of angled receptacle contacts 148 at the rearward end 144 of the lead frame base 140 extend at an acute angle toward the forward end of the base 140. Each barrel IDC contact 146 is connected to a respective one of the angled receptacle contacts 148 through internal conductive traces 150 embedded in the lead frame base 140. The lead frame assembly 96 includes lead frame wires 190 (see FIG. 6) that interconnect the front interface contacts 90 and the barrel IDC contacts 146 to complete signal paths from the front interface contacts 90 to the angled contacts 148. Thus, the lead frame assembly 96 interconnects each of the front interface contacts 90 with a respective one of the angled receptacle contacts 148 at the rear interface end 86 of the adapter module 72.

The lead frame assembly 96 is received in the lead frame well 130 such that the rearward end 144 extends into the receptacle housing 126 at the rearward end 86 of the adapter module 72. Angled contacts 148 are then accessible to an appropriate plug connector such as the plug connector 74 (shown in FIG. 2). The lead frame base 140 includes locking tabs 154 along opposite side edges 156. The locking tabs 154 are received in pockets 158 formed in side walls 160 of the lead frame well 130 to retain the lead frame assembly 96 in the lead frame well 130. Once assembled, it is not intended that the lead frame assembly 96 be removed from the housing base 92.

Figure 5:
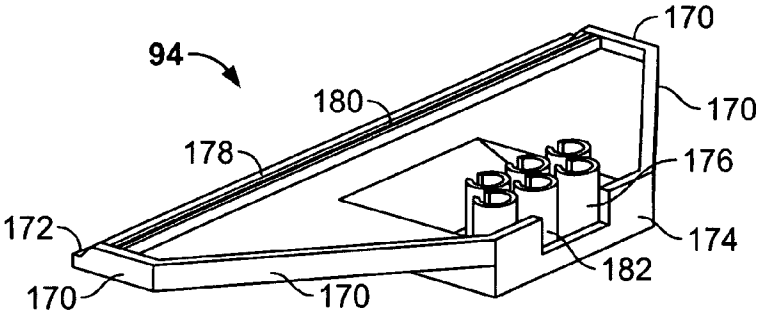
FIG. 5 is a bottom perspective view of an interface module cover.

FIG. 5 is a bottom perspective view of the cover 94 of the adapter module cover 72. The cover 94 includes segmented side walls 170 that extend from a front edge 172 to a rear face 174 that includes a cutout 176. An interior wall 178 extends transversely across the cover 94 proximate the front edge 172. The interior wall 178 includes a groove 180 that receives an upper edge of the IDC contacts 104 (FIG. 4) to partially retain the IDC contacts 104. The cover 94 also includes terminating tubes 182 that are positioned to align with and receive the barrel IDC contacts 146 (FIG. 4) when the cover 94 is installed on the housing base 92 (FIG. 4). The terminating tubes 182 force the lead frame wires 190 into the slits 147 of the barrel IDC contacts 146 to terminate the lead frame wire connections to the barrel IDC contacts 146.

Figure 6:
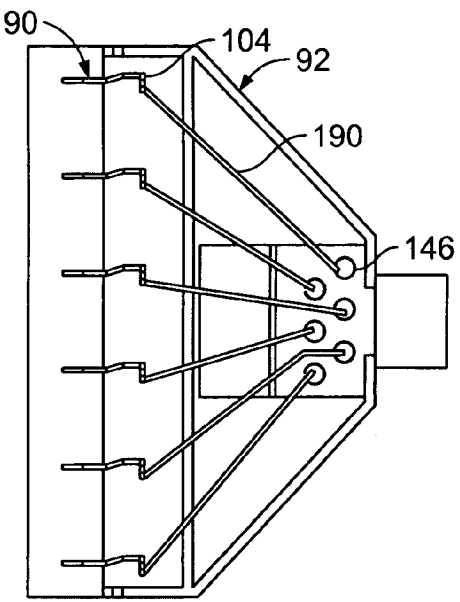
FIG. 6 is a top plan view showing internal wire routing within the interface module shown in FIGS. 2 and 3.

FIG. 6 is a top plan view illustrating the lead frame wire routing within the adapter module 72. The adapter module 72 includes interior lead frame wires 190 that interconnect each front interface contact 90 with a barrel IDC contact 146 to establish a conductive path from each front interface contact 90 to an angled contact 148 at the rear 144 of the lead frame assembly 96. Thus, the lead frame assembly 96 with the lead frame wiring 190 provides a wiring network that receives network sensor wiring in an IDC configuration at the adapter front interface end 84 and converts the network sensor wiring to a different configuration, such as an RJ11 configuration, at the adapter rear interface end 86.

The adapter module 72 is used in monitored network systems to sense and report network interconnect activity to a monitoring station or control station. When a network component (not shown) is connected to the network using a patch cord 30 (FIG. 1) at a network interconnect module 10, the sensor probe 40 contacts the sensor pad 28 on the sensor contact 20. The sensor signal reflective of the action is available a sensor tower 78 (FIG. 2) on the rear side 22 of the interconnect module 10. Rather than manually punching down a wire into the IDC contact (not shown) within the sensor tower 78, the adapter module 72 is provided that has a first contact format at the front interface end 84 that can be mated with the IDC contacts in the sensor tower 78 to receive the sensor signal. At the rear interface end 86, the adapter module 72 provides a second contact format, such as an RJ11 format, that is different from the front interface contact format. Through the use of a standard plug connector such as an RJ11 plug 74 (FIG. 2), the sensor signal can be easily routed to a monitoring station or provided to a network monitoring system.

The embodiments thus described provide an interface adapter module 72 that receives sensor signals at an IDC interface at the adapter front end 84 and provides the signal at a rear interface end 86 in an RJ11 connector format. Use of the adapter module 72 avoids the punch down process which would otherwise be required to make a sensor connection at the IDC contacts in the interconnect sensor towers 78. Use of the adapter 72 minimizes the vulnerability of sensor connections to damage or deterioration when disconnects and reconnects are made.

While the invention has been described in terms of various specific embodiments, those skilled in the art will recognize that the invention can be practiced with modification within the spirit and scope of the claims.

What is claimed is:

1. A network interface adapter module comprising:

a housing having a front interface end in a first contact format and a rear interface end in a second contact format different from said first contact format, said housing including a plurality of front interface contacts, each said front interface contact configured to receive a network sensor signal; and a lead frame assembly within said housing, said lead frame assembly interconnecting each of said plurality of front interface contacts with a respective one of a plurality of receptacle contacts at said rear interface end, wherein said housing includes a base and said front interface contact includes an elongated body having a blade formed at a forward end thereof and an insulation displacement contact (IDC) contact formed at an opposite rearward end, said blade and said IDC contact extending vertically upward from said base.

2. The network interface adapter module of claim 1, wherein said housing includes a base and a cover joined to said base.

3. The network interface adapter module of claim 1, wherein said housing includes a shroud at said front interface end.

4. The network interface adapter module of claim 1, wherein said front interface end is configured to be joined with a front loadable interconnect module.

5. The network interface adapter module of claim 1, wherein said housing includes a shroud at said front interface end and said front interface contacts include blade portions positioned within said shroud.

6. The network interface adapter module of claim 1, wherein said housing includes a base having a well for receiving said lead frame.

7. The network interface adapter module of claim 1, wherein said plug interface end comprises an RJ11 interface.

8. A network interface adapter module comprising:

a housing having a front interface end in a first contact format and a rear interface end in a second contact format different from said first contact format, said housing including a plurality of front interface contacts, each said front interface contact configured to receive a network sensor signal; and a lead frame assembly within said housing, said lead frame assembly interconnecting each of said plurality of front interface contacts with a respective one of a plurality of receptacle contacts at said rear interface end, wherein said housing includes a base having a plurality of contact slots, said front interface contacts being loaded into said contact slots in a direction substantially perpendicular to an upper surface of said housing base.

9. A network interface adapter module comprising:

a housing having a front interface end in a first contact format and a rear interface end in a second contact format different from said first contact format, said housing including a plurality of front interface contacts, each said front interface contact configured to receive a network sensor signal; and a lead frame assembly within said housing, said lead frame assembly interconnecting each of said plurality of front interface contacts with a respective one of a plurality of receptacle contacts at said rear interface end, wherein said lead frame assembly includes lead wires connecting said front interface contacts to barrel IDC contacts.

10. The network interface adapter module of claim 9, wherein said lead frame assembly includes a lead frame base having a forward end and a rearward end, said barrel IDC contacts extending vertically upward from said lead frame base, and a plurality of angled contacts extending from said rearward end, said lead frame base including imbedded conductive traces connecting respective ones of said barrel IDC contacts and said angled contacts.

11. A network interconnect and interface adapter system comprising:

an interconnect module having a face plate and a rear side, the interconnect module including receptacle jacks and sensor contacts, the receptacle jacks being mounted in the interconnect module and open at the face plate, the sensor contacts being located proximate the receptacle jacks and extending through the face plate to the rear side of the interconnect modulee; and an interface adapter module configured to be joined to the rear side of the interconnect module, the interface adapter module comprising:

a housing having a front interface end and a rear interface end different from said front interface end, said housing including a plurality of front interface contacts, each said front interface contact configured to mate with a corresponding one of said sensor contacts to receive corresponding network sensor signals; and a wiring network within said housing, said wiring network receiving network sensor wiring in a first configuration from said front interface end and converting said network sensor wiring to a second configuration at said rear interface end.

12. The network interconnect and interface adapter system of claim 11, wherein said housing includes a base having a well for receiving said wiring network.

13. The network interconnect and interface adapter system of claim 11, wherein said wiring network includes a lead frame assembly, said lead frame assembly including a lead frame base having a forward end and a rearward end, a plurality of barrel IDC contacts extending vertically upward from said lead frame base, and a plurality of angled contacts extending from said rearward end, said lead frame base including imbedded conductive traces connecting respective ones of said barrel IDC contacts and said angled contacts.

14. The network interconnect and interface adapter system of claim 11, wherein said wiring network includes a lead frame assembly and a plurality of lead frame wires, said lead frame wires being connected to respective ones of said front interface contacts.

15. The network interconnect and interface adapter system of claim 11, wherein said housing includes a base and a cover and said wiring network includes a lead frame assembly and a plurality of lead frame wires, said lead frame assembly including a plurality of barrel IDC contacts, said lead frame wires interconnecting respective ones of said front interface contacts and barrel IDC contacts, said cover including terminating members configured to align with said barrel IDC contacts when said cover is installed on said housing base.

16. The network interconnect and interface adapter system of claim 11, wherein said housing includes a base and said front interface contact includes an elongated body having a blade formed at a forward end thereof and an IDC contact formed at an opposite rearward end, said blade and said IDC contact extending vertically upward from said housing base.

17. The network interconnect and interface adapter system of claim 11, wherein said housing includes a base having a plurality of contact slots, said front interface contacts being loaded into said contact slots in a direction substantially perpendicular to an upper surface of said housing base.

18. The network interconnect and interface adapter system of claim 11, wherein said housing includes a shroud at said front interface end and said front interface contacts include blade portions positioned within said shroud.

* * * * *

UNITED STATES PATENT AND TRADEMARK OFFICE

CERTIFICATE OF CORRECTION

PATENT NO. : 7,066,770 B2
APPLICATION NO. : 10/832550
DATED : June 27, 2006
INVENTOR(S) : Paul John Pepe It is certified that error appears in the above-identified patent and that said Letters Patent is hereby corrected as shown below:

Col. 6 in Claim 1, line 5, insert --and a plurality of receptacle contacts-- after "contacts" and before ",";

Col. 6 in Claim 1, line 10, delete the second occurrence of "a" and replace it with --said--;

Col. 6 in Claim 8, line 5, insert --and a plurality of receptacle contacts-- after "contacts" and before ",";

Col. 6 in Claim 8, line 10, delete the second occurrence of "a" and replace it with --said--;

Col. 7 in Claim 9, line 5, insert --and a plurality of barrel insulation displacement contact (IDC) contacts-- after "contacts" and before ",";

Col. 7 in Claim 9, line 10, delete the second occurrence of "a" and replace it with --said--;

Col. 7 in Claim 9, line 11, delete "receptacle" and replace it with --barrel IDC--; and Col. 7 in Claim 9, line 13, insert --said-- after "to" and before "barrel".

Signed and Sealed this

Twenty-third Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,066,770 B2
APPLICATION NO. : 10/832550
DATED : June 27, 2006
INVENTOR(S) : Paul John Pepe It is certified that error appears in the above-identified patent and that said Letters Patent is hereby corrected as shown below:

Col. 6 in Claim 1, line 12, insert --and a plurality of receptacle contacts-- after "contacts" and before ";";

Col. 6 in Claim 1, line 17, delete the second occurrence of "a" and replace it with --said--;

Col. 6 in Claim 8, line 47, insert --and a plurality of receptacle contacts-- after "contacts" and before ";";

Col. 6 in Claim 8, line 52, delete the second occurrence of "a" and replace it with --said--;

Col. 6 in Claim 9, line 63, insert --and a plurality of barrel insulation displacement contact (IDC) contacts-- after "contacts" and before ",";

Col. 7 in Claim 9, line 1, delete the second occurrence of "a" and replace it with --said--;

Col. 7 in Claim 9, line 2, delete "receptacle" and replace it with --barrel IDC--; and Col. 7 in Claim 9, line 4, insert --said-- after "to" and before "barrel".

This certificate supersedes the Certificate of Correction issued February 23, 2010.

Signed and Sealed this

Sixteenth Day of March, 2010

David J. Kappos

David J. Kappos
*Director of the United States Patent and Trademark Office*